United States Patent [19]

Rostron

[11] 4,229,627

[45] Oct. 21, 1980

[54] GAS PUFFER TYPE CURRENT INTERRUPTER AND METHOD

[75] Inventor: Joseph R. Rostron, Murrysville, Pa.

[73] Assignee: Electric Power Research Institute, Inc., Palo Alto, Calif.

[21] Appl. No.: 948,390

[22] Filed: Oct. 4, 1978

[51] Int. Cl.[3] ..... H01H 33/00

[52] U.S. Cl. ..... 200/144 R; 200/148 A

[58] Field of Search ..... 200/144 R, 148 R, 148 A, 200/148 B, 148 C, 148 D, 148 E, 148 F, 148 G, 148 H, 148 J, 148 BV, 150 G

[56] References Cited

PUBLICATIONS

Murano et al., "Heavy Current Clogging Phenomena in $SF_6$ Gas Arc", *IEEE Power Engineering Society Conference Paper,* C74 185-5, presented at the IEEE Power Engineering Society Winter Meeting, Jan. 27-Feb. 1, 1974.

Noeske, "Investigation of Dynamic Nozzle Parameters for Various Nozzle Geometries and Test Conditions of an Experimental Half-Size $SF_6$ Puffer Breaker", *IEEE Transactions,* vol. 96, No. 3, May-Jun. 1977, pp. 896-906.

Tominaga et al, "Estimation and Performance Investigation on SLF Interrupting Ability of Puffer-Type Gas Circuit Breaker", *IEEE Power Engineering Society Conference Paper,* presented at the IEEE Power Engineering Society Winter Meeting, Jan. 1978.

Yoshioka et al., "A Method and Applications of a Theoretical Calculation for On-Load Pressure Rises in Puffer Type Gas Circuit Breakers ", *IEEE Power Engineering Society Conference Paper,* F78 682-7, presented at the IEEE Power Engineering Society Summer Meeting, Jul. 16-21, 1978.

*Primary Examiner*—J. V. Truhe
*Assistant Examiner*—Morris Ginsburg
*Attorney, Agent, or Firm*—Flehr, Hohbach, Test, Albritton & Herbert

[57] ABSTRACT

The invention provides for a gas puffer type current interrupter having a pair of separable contacts, one of which is surrounded by a nozzle formed of electrically insulating material. Upon separation, an arc is drawn between the contacts through the throat of the nozzle. The method of the invention includes permitting the arc to fill and clog the nozzle throat thereby restricting the escape of dielectric gas which is being forced into the nozzle. The clogging of the nozzle by the arc is permitted to an extent sufficient to raise the temperature within the nozzle such that significant ablation of the nozzle material occurs interior of the nozzle. The ablation or evaporation of the nozzle material produces a significant increase in pressure within the nozzle which serves to rapidly extinguish the arc. The interrupter includes a nozzle having a throat size selected so that the cross sectional area of the arc substantially fills the throat. The nozzle will be clogged a sufficient portion of the time between contact separation and arc extinction to produce the desired ablation of the nozzle material.

17 Claims, 4 Drawing Figures

GAS PUFFER TYPE CURRENT INTERRUPTER AND METHOD

BACKGROUND OF THE INVENTION

The present invention is directed to a current interrupter of the gas puffer type employing a dielectric gas forced through a nozzle into the arcing region between a pair of separable contacts.

In current interrupters of the gas puffer type where, upon contact separation, an arc extends through the throat of an insulating nozzle, the "clogging" of the nozzle by the arc has heretofore been considered undesirable. "Clogging" is a condition where the cross sectional area of the arc completely or substantially fills the orifice forming the nozzle throat. In gas puffer type interrupters, pressurized dielectric gas (for example, sulfur hexafluoride, $SF_6$) is forced into the nozzle for discharge through the throat. The dielectric gas serves to cool the arc and the released arcing products and to minimize the hot gases that accumulate upstream of the nozzle throat. A clogged condition will prevent escape of the gas, causing a large increase in temperature in the vicinity of the arc.

Although clogging is known to occur in prior art interrupters to a limited extent, it has generally been considered undesirable. Interrupters have been designed to minimize clogging by increasing the nozzle throat and contact sizes with higher interrupter current ratings. Since the cross sectional area of an arc is dependent on many factors, including ambient pressure, temperature and other conditions, as well as the magnitude of current carried, it has been difficult to precisely predict interrupter performance to completely eliminate clogging. Prior art alternating current interrupters have therefore been designed so that clogging occurs no more than fifty percent of the time during arcing, and preferably substantially less.

OBJECTS AND SUMMARY OF THE INVENTION

It is an object of the present invention to provide a method of current interruption for use in a current interrupter of the gas puffer type in which the current interruption capacity of the interrupter is significantly increased.

Another object of the invention is to provide a method of current interruption in which the pressure within the gas discharge nozzle of a gas puffer type interrupter is significantly increased to more rapidly extinguish the arc.

Another object of the invention is to provide a gas puffer type current interrupter in which the gas discharge nozzle is clogged to an extent sufficient to cause significant ablation of the nozzle material.

Accordingly, the invention provides a current interrupter of the gas puffer type having a pair of relatively movable contacts and a nozzle formed of electrically insulating material surrounding a first of the contacts. The nozzle includes a nozzle throat into which a second of the contacts extends to engage the first contact when the contacts are closed. The second contact is withdrawn from the nozzle when the contacts are opened, permitting an arc to arise between the contacts through the nozzle throat. Means are provided for directing a dielectric gas into the nozzle for discharge through the nozzle throat. The size of the nozzle throat is selected so that the cross sectional area of the arc will substantially fill the nozzle throat and restrict escape of the dielectric gas therefrom to an extent sufficient to raise the temperature within the nozzle such that significant ablation of the nozzle material occurs within the nozzle.

The method of current interruption for use with the above-described interrupter includes the following steps: separating the contacts including withdrawing the second contact from the nozzle throat to permit an arc to arise between the contacts through the nozzle throat; directing dielectric gas into the nozzle under pressure; and causing the arc arising between the contacts to substantially fill the nozzle throat to restrict escape of the dielectric gas from the nozzle to an extent sufficient to raise the temperature within the nozzle such that significant ablation of the nozzle material occurs within the nozzle. The ablation of the nozzle material produces a significant increase in pressure within the nozzle to rapidly extinguish the arc.

DESCRIPTION OF THE PREFERRED EMBODIMENT

Figure 1:
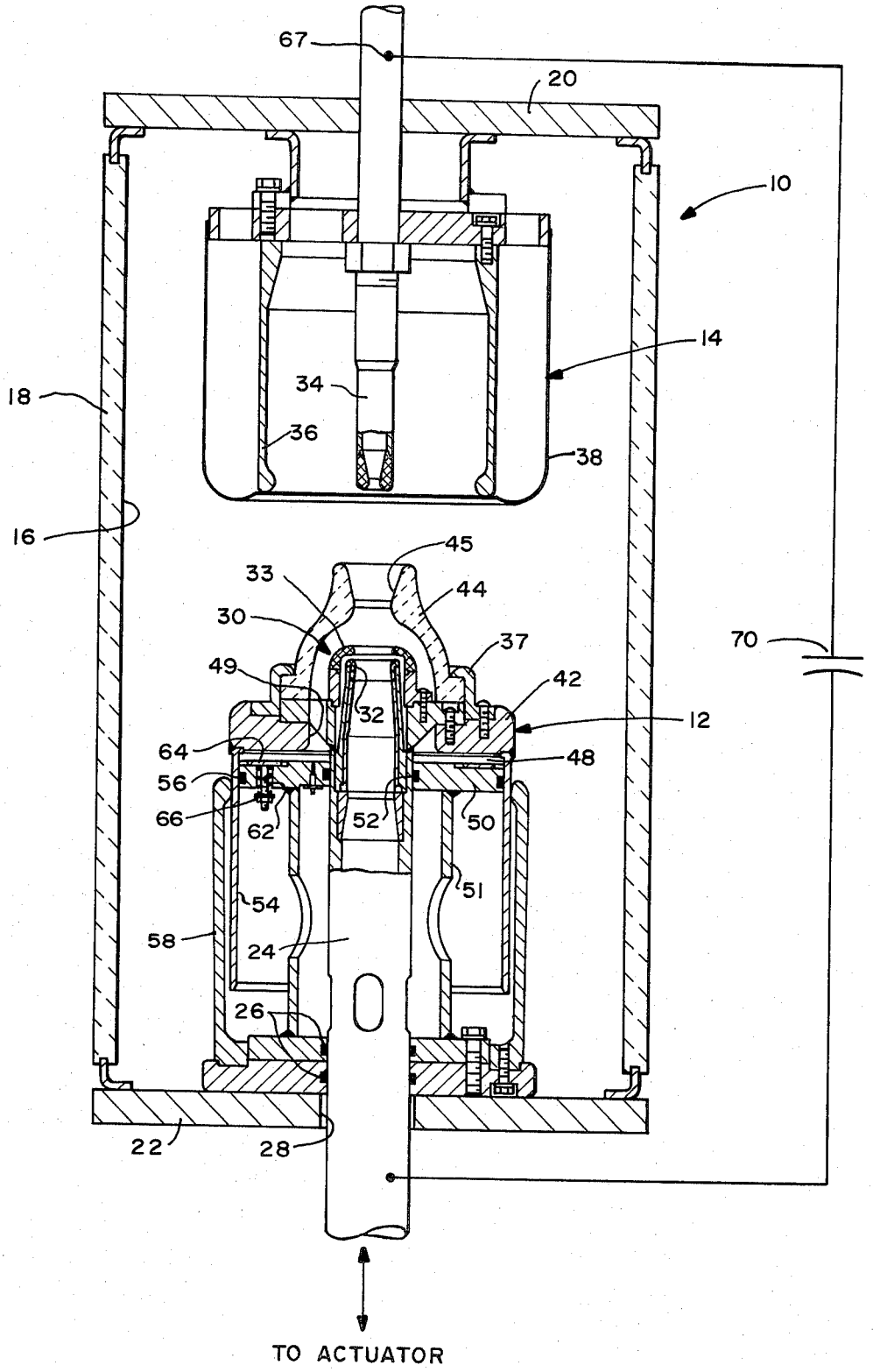
FIG. 1 is a cross sectional view of a current interrupter according to the present invention.

Referring to FIG. 1, a current interrupter according to the present invention is shown generally at 10. The interrupter includes a pair of relatively movable contact assemblies 12 and 14 within an enclosure 16 filled with a dielectric gas such as sulfur hexafluoride ($SF_6$). Enclosure 16 preferably includes side walls 18 formed of an insulating material to which end plates 20 and 22 are sealed. Lower assembly 12 includes a movable shaft 24 which extends downwardly through suitable sliding seals 26 to the exterior of enclosure 16 through opening 28 in end plate 22. The upper end of shaft 24 is a first contact 30 which includes a plurality of fingers 32. A protective cap 33 covers fingers 32 to prevent damage to the fingers during arcing. Upper assembly 14 forms a stationary contact assembly which includes a downwardly-extending second contact 34 in the form of a probe. Contact 34 is surrounded by a plurality of fingers 36 which engage a conductive ring 37 on the lower assembly 12, providing an additional path for current flow when the contacts are closed. A metal voltage shield 38 surrounds second contact 34 and fingers 36. Stationary assembly 14 is supported in any suitable manner from upper plate 20.

Figure 2:
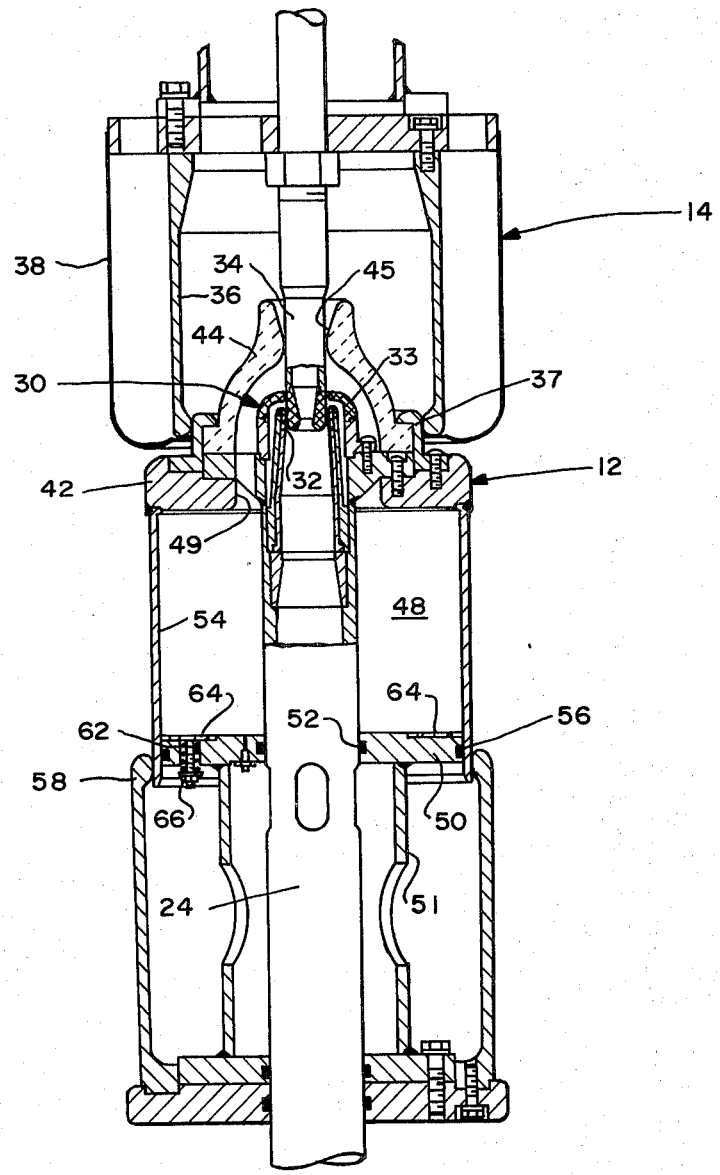
FIG. 2 is a partial cross sectional view of the interrupter of FIG. 1 with the contacts closed.

A conductive support block 42 which moves with shaft 24 forms an integral part of movable assembly 12. Support block 42 supports ring contact 37 and also supports a gas discharge nozzle 44, formed of a suitable insulating material such as Teflon (TM) which surrounds first contact 30. Nozzle 44 is secured to support block 42 by ring contact 37. Nozzle 44 includes a nozzle throat 45 through which first contact 30 is adapted to extend when the contacts are closed, as shown in FIG. 2. The nozzle is selected so that the cross sectional area of an arc between contacts 30 and 34 will fill throat 45 and produce clogging, in the manner described below. More specifically, the nozzle throat will be relatively smaller than nozzle throats in similar interrupters designed for predominantly unclogged operation. Since arc cross sectional area is dependent on the current magnitude carried by the arc, the interrupter 10 will have relatively larger contacts for a given nozzle throat size than similar interrupters designed for unclogged operation. The contacts 30 and 34 and their respective assemblies are selected to carry at least a predetermined magnitude of current which will produce an arc which substantially fills and clogs nozzle throat 45.

The movable contact assembly 12 is integral with a gas compressing means suitable for compressing and directing a dielectric gas into the arcing region between the contacts. In the preferred embodiment, the gas compressing means includes a gas compressing chamber 48, seen most clearly in FIG. 2, communicating with nozzle 44 through flow passageway 49. Chamber 48 forms part of a means for directing dielectric gas into nozzle 44 under pressure to facilitate arc extinction. When the contacts are closed, as shown in FIG. 2, chamber 48 assumes its maximum interior volume. A fixed plate 50 supported by a cylindrical support 51 surrounds shaft 24 and forms the bottom of the chamber. Shaft 24 moves relative to plate 50 through a sliding seal 52. The side walls of chamber 48 comprise a cylinder 54 attached at the upper end to contact support block 42. Walls 54 engage support plate 50 by means of sliding seals 56. A plurality of fingers 58 provide a current path between movable contact assembly 12 and lower end plate 22. During contact closure, the volume of chamber 48 expands and dielectric gas from within enclosure 16 enters through nozzle 44 and also through a plurality of holes 62 in support plate 50. A loosely fitting ring-shaped check plate 64 covers holes 62 and serves as a one-way valve. Suitable retainers 66 are employed to maintain the position of check plate 64.

Coupled to the lower end of rod 24 is a suitable actuating apparatus (not shown) for imparting motion to the rod. Rod 24 serves as means for separating contacts 30 and 34 and their respective assemblies. Specifically, rod 24 serves to raise and lower support block 42 to which first contact 30 and nozzle 44 are coupled. By moving block 42, rod 24 is mechanically connected to the movable parts of gas compressing chamber 48. As is standard in gas puffer type interrupters, the single actuating rod 24 will, therefore, simultaneously pressurize the dielectric gas in chamber 48 and direct the gas into the nozzle, and also separate the contacts (see FIG. 3). The actuator coupled to rod 24 must be relatively powerful and must also be capable of separating the interrupter contacts rapidly. Preferably the actuator will be able to separate the contacts within several milliseconds.

In operation, the interrupter 10 is installed on a power line. One power line terminal would be connected to first contact 30 and the movable contact assembly in any suitable manner (not shown). For example, the power line terminal could be connected to end plate 22. The other power line terminal would be connected to stationary assembly 14, for example at 67. A capacitive impedance 70 is installed in parallel with the interrupter to serve as a shunt. During normal current carrying operation, the contacts are closed, as shown in FIG. 2. When closed, second contact 34 extends into nozzle throat 45, engaging fingers 32 of first contact 30 to complete a current path. In addition, fingers 36 of the stationary assembly engage ring contact 37 of the movable assembly. When the contacts are closed, the power line current passes freely through the interrupter and no current is diverted to capacitor 70.

The interrupter is preferably associated with an external fault detection system (not shown) which monitors circuit conditions. If circuit isolation is called for, a signal is sent to the previously-mentioned actuator coupled to rod 24 to open the contacts. Upon receipt of an "open" signal, the method of current interruption according to the present invention is initiated.

Figure 3:
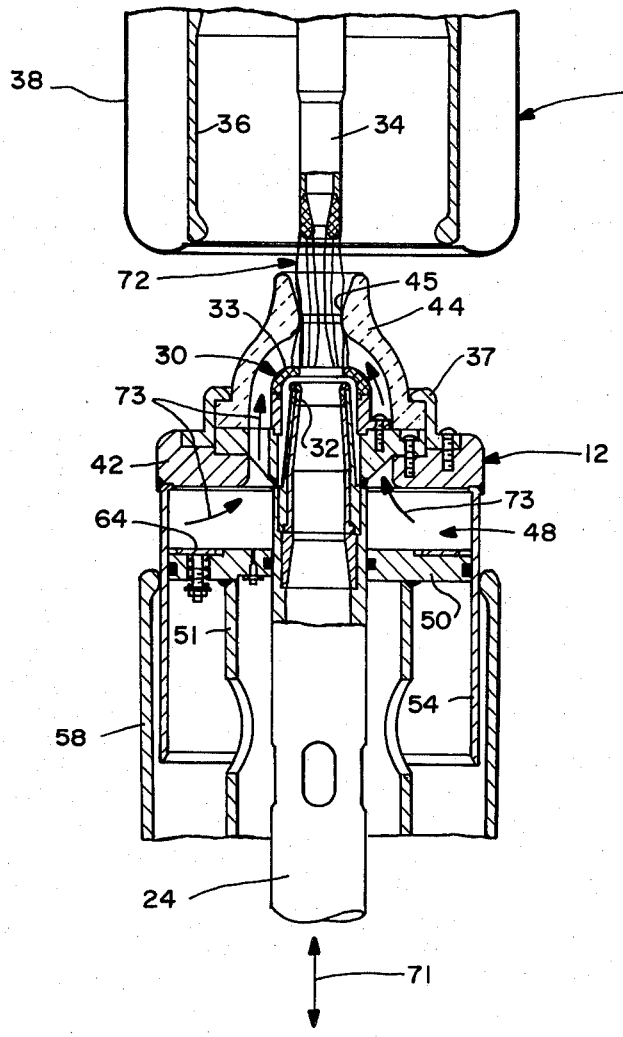
FIG. 3 is a partial cross sectional view of the interrupter of FIG. 1 on a reduced scale showing the operation of the interrupter during contact opening.

Starting with the contacts closed and engaged, as shown in FIG. 2, at least a predetermined magnitude of current is first passed through interrupter 10. The current magnitude should be sufficient to produce clogging of nozzle throat 45 by arcing upon contact separation. The relationship between arc size and current magnitude is discussed more fully below. To interrupt the current passing through the interrupter, the contacts are opened, as shown in FIG. 3. The previously described actuator moves rod 24 downwardly in the direction of arrow 71, causing movable contact assembly 12 to descend. The contacts are thereby separated, with second contact 34 being withdrawn from nozzle throat 45. The contact assemblies 12 and 14 are constructed to provide a specific order of separation. Ring contact 37 and fingers 36 separate first, followed by probe 34 and fingers 32. The order of separation insures that an arc 72 is drawn between contacts 30 and 34 through nozzle throat 45. The arc extends predominantly between the tip of probe 34 and cap 33, with the latter serving to protect fingers 32 from destruction from the arc. As moving contact assembly 12 descends, the gas within gas compressing chamber 48 is pressurized and forced to exit the chamber, as illustrated by arrows 73. The dielectric gas is directed into nozzle 44 under pressure, escaping into enclosure 16 through nozzle throat 45. Until the nozzle becomes clogged, the pressurized $SF_6$ gas serves to cool the arc 72 and the contacts and helps to increase the arc voltage, as in conventional gas puffer type interrupters.

As noted above, the size of the nozzle throat is selected with knowledge of the current magnitude to be carried by the interrupter, so as to produce clogging of the nozzle by the arc drawn between the contacts. The cross sectional area of arc 72 through the nozzle throat is dependent on the current carried by the arc, as is discussed more fully below. Referring to FIG. 3, when the interrupter is operated according to the present invention, arc 72 arising between contacts 30 and 34 is caused to substantially fill and block nozzle throat 45, restricting escape of the pressurized dielectric gas from the nozzle. The arc thus clogs the nozzle, effectively blocking the nozzle throat. Current magnitude and nozzle throat sizes are selected so that escape of gas is restricted to an extent sufficient to substantially raise the temperature within the nozzle. The rise in temperature occurs because the flow of cooling dielectric gas is substantially cut off. Instead, there is a build up of pressure within the nozzle. The temperature rises rapidly due to the 20,000–40,000° K. arc temperature, and eventually causes significant ablation or evaporation of the nozzle material (Teflon). Teflon ablation contributes further to the increase in pressure within nozzle 44. The high pressure helps to produce rapid arc extinction.

When the interrupter and method of the present invention are employed to interrupt an alternating current, it is known that the arc 72 will be periodic. Because the arc will vary in size, it will not clog nozzle 44 at all times. In such an application, it is recommended that the size of nozzle throat 45 be such that the arc substantially fills and blocks the nozzle throat at least fifty percent of the time between contact separation and arc extinction. It has been determined that if the nozzle is clogged at least fifty percent of the time, and preferably between sixty and ninety percent of the time, sufficient ablation of the nozzle will occur to produce the necessary pressure increase between current zeros to rapidly extinguish the arc.

Experimental results with the present invention have acheieved successful current interruptions of 100 kA r.m.s. with a nozzle throat diameter of 1.5 inches. Experiments were conducted using $SF_6$ in enclosure 16 at 75 pounds per square inch pressure. With the clogging of nozzle 44 and the resultant Teflon ablation, pressures within the nozzle exceeded 350 pounds per square inch. With 60 Hz alternating current, arc extinction was achieved within one or two current half-cycles.

The invention represents a significant improvement in performance for gas puffer type interrupters. Prior art gas puffer interrupters with one break have generally been rated at no more than 50 kA r.m.s. interruption capacity, and such interrupters generally had to employ very large shunt capacitors (for example, 12,000 pf). The present invention, using a heavily clogged nozzle, can be employed to interrupt currents exceeding 120 kA with only 6,000 pf shunt capacitance. This significant improvement in performance is the result of the much higher pressures produced within the Teflon nozzle due to ablation. Although clogging does produce some undesirable side effects such as an accumulation of hot gases upstream of the nozzle throat, the increase in pressure within the nozzle is a significant benefit which more than offsets the disadvantages of clogged operation.

In constructing an interrupter according to the present invention, some knowledge of the relationship between the cross sectional area of the arc 72 and the current carried by the arc is desirable. It is known, for example, that arc cross sectional area is related to current magnitude, arc temperature, and ambient pressure. Studies have been conducted of these relationships; for example, see Murano et al, "Heavy Current Clogging Phenomena in $SF_6$ Gas Arc," *IEEE Power Engineering Society Conference Paper,* presented at the IEEE Power Engineering Society Winter Meeting, New York, N.Y., Jan. 27–Feb. 1, 1974. Given the rapidly fluctuating conditions of temperature and pressure within the arcing environment, however, the precise relationship between arc cross sectional area and current magnitude cannot be readily calculated. Nevertheless, as a first approximation, empirical results reveal that current magnitude and pressure are of primary importance in determining the cross sectional area of the arc. Of these two parameters, the current is most easily measured and controlled since pressure in the arcing region fluctuates greatly. The following formula is believed to approximate the relationship between arc cross sectional area (A), and current magnitude (I) and pressure (P):

$$A \propto \sqrt{I/P}$$

Figure 4:
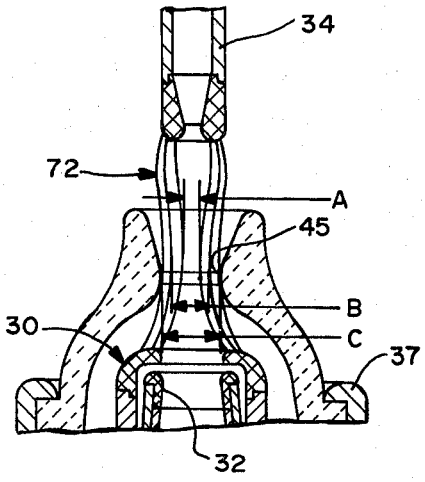
FIG. 4 is a partial cross sectional view of the interrupter contacts illustrating arcs of different cross sectional areas which are produced at different current magnitudes.

FIG. 4 illustrates the observed relationship between arc diameter and current magnitude in the interrupter of the present invention. Three arcs having diameters A, B and C are shown. The smaller arcs A and B have cross sectional areas which do not completely fill nozzle throat 45 and therefore would not produce a fully clogged nozzle. The arc with diameter C does completely fill and clog the nozzle throat. Arcs A, B and C are produced by progressively larger currents. To employ the method of the present invention it is necessary to have a nozzle throat selected such that the cross sectional area of the arc will substantially fill the nozzle throat. In other words, given an interrupter current of a predetermined magnitude sufficient to produce arc C, the nozzle throat should be the size shown in FIG. 4. If the current produces arcs A or B, the nozzle throat would have to be smaller to operate according to the present invention. If the current is an alternating current, the arc will be periodic and vary between (and perhaps beyond) sizes A, B and C. In such AC applications, the predetermined current magnitude (r.m.s.) will be that which will produce arc C or larger at least fifty percent of the time during arcing, and preferably sixty to ninety percent of the time.

In general, the current which will produce clogging and thereby permit operation of the interrupter according to the present invention will be in a predetermined range. A minimum current is required, as illustrated in FIG. 4, to cause clogging sufficient to cause Teflon ablation. Beyond that, the current can increase up to levels which will produce premature destruction of the contacts or nozzle. It should therefore be noted that the interrupter can operate successfully over a range of currents. As such, interrupters of the present invention can be installed on power lines on which normal load growth will be experienced.

The present invention improves the current interrupting capacity of gas puffer type interrupters. The deliberate encouragement and use of clogging has been found to significantly increase the magnitude of currents which can be interrupted by such devices. Furthermore, it has been found that interrupters employing Teflon ablation have longevity equivalent to prior art interrupters. No significant damage is inflicted by the induced clogging or by the ablation of the nozzle over and above that experienced in prior art puffer type interrupters. As noted above, the interrupter achieves increased performance using less shunt capacitance than prior art interrupters.

Alternative embodiments are possible within the scope of the invention. For example, alternative contact assemblies will readily occur to those skilled in the art. The upper contact can be movable and the lower contact stationary, for example. Alternative gas compressing chambers suitable for use in the present invention can be readily conceived. Materials which produce similar interior pressure increases from ablation could be used for the nozzle, instead of Teflon. A dielectric gas other than $SF_6$ could be employed in the interrupter, for example selenium hexafluoride ($SeF_6$) or another effective dielectric gas.

A method of current interruption has been provided for use in a current interrupter of the gas puffer type in which current interruption capacity is significantly increased. The method of current interruption provides for significant increases in the pressure within the gas discharge nozzle to more rapidly extinguish the arc. The gas puffer type current interrupter of the invention provides a gas discharge nozzle which is clogged to an extent sufficient to cause significant ablation of the nozzle material.

What is claimed is:

1. A method of current interruption for use in a current interrupter having a pair of relatively movable contacts including a first said contact disposed in a nozzle formed of electrically insulating material having a nozzle throat and a second said contact extending into said nozzle throat and engaging said first contact to complete a current path, said method comprising the steps of: separating said contacts to interrupt current flow such that an arc arises between said contacts, including causing the withdrawal of said second contact from said nozzle throat whereby the arc extends through said nozzle throat substantially filling said nozzle throat, directing dielectric gas into said nozzle under pressure, clogging said nozzle throat with the arc arising between said contacts to restrict escape of said dielectric gas from said nozzle, and continuing the clogging of said nozzle throat to an extent sufficient to raise the temperature within said nozzle such that significant ablation of said nozzle material occurs within said nozzle thereby producing a significant increase in pressure within said nozzle to rapidly extinguish said arc.

2. A method as in claim 1 in which the current interrupted is an alternating current which produces an arc between said contacts which is periodic, said step of continuing the clogging of said nozzle throat including filling and blocking said nozzle throat with the periodic arc to restrict escape of said dielectric gas at least fifty percent of the time between contact separation and arc extinction.

3. A method as in claim 1 in which said current interrupter is of a gas puffer type having a gas compressing chamber containing said dielectric gas communicating with said nozzle and mechanically connected to means for separating said contacts, wherein said step of separating said contacts simultaneously pressurizes said dielectric gas in said chamber and directs said dielectric gas into said nozzle under pressure.

4. A method as in claim 1 in which the cross sectional area of said arc extending through said nozzle throat is dependent on the current carried by said arc, said method including initially passing at least a predetermined magnitude of current through said interrupter when said contacts are engaged, said predetermined magnitude of current being a current sufficient to produce an arc upon contact separation having a cross sectional area which substantially fills said nozzle throat.

5. A method as in claim 1 in which said step of continuing the clogging of said nozzle throat is continued until the interior pressure in said nozzle exceeds 350 pounds per square inch.

6. A method of current interruption for use in a gas puffer type current interrupter having an enclosure filled with a dielectric gas, a pair of relatively movable contacts in said enclosure including a first said contact disposed in a nozzle formed of electrically insulating material having a nozzle throat and a second said contact extending into said nozzle throat and engaging said first contact to complete a current path, said contacts being separable to permit an arc to arise between said contacts through said nozzle throat, the cross sectional area of said arc being dependent on the current carried by said arc, and a gas compressing chamber in said enclosure communicating with said nozzle, said method comprising the steps of: passing at least a predetermined magnitude of current through said interrupter when said contacts are engaged, said predetermined magnitude of current being sufficient to cause the arc arising upon contact separation to have a cross sectional area which substantially fills and clogs said nozzle throat, separating said contacts including causing the withdrawal of said second contact from said nozzle throat whereby an arc arises through said nozzle throat, compressing said dielectric gas in said gas compressing chamber and directing the resultant pressurized dielectric gas into said nozzle, clogging said nozzle throat with said arc to restrict escape of said dielectric gas through said nozzle throat, and continuing the clogging of said nozzle throat to an extent sufficient to raise the temperature within said nozzle such that significant ablation of said nozzle material occurs within said nozzle thereby producing a significant increase in pressure within said nozzle to rapidly extinguish said arc.

7. A method as in claim 6 in which said step of passing current through said interrupter includes passing an alternating current of at least a predetermined magnitude through said interrupter when said contacts are engaged whereby the arc produced when said contacts are separated is periodic, said predetermined magnitude of alternating current being a current sufficient to cause said periodic arc to have a cross sectional area which substantially fills and clogs said nozzle throat to restrict escape of said dielectric gas at least fifty percent of the time between contact separation and arc extinction.

8. A method as in claim 6 in which said step of continuing the clogging of said nozzle throat is continued until the interior pressure in said nozzle exceeds 350 pounds per square inch.

9. A current interrupter of the gas puffer type comprising: a pair of relatively movable contacts, a nozzle formed of electrically insulating material surrounding a first said contact, said nozzle having a nozzle throat, a second said contact which extends into said nozzle throat when engaging said first contact, said first and second contacts being relatively movable to separate said contacts and to remove said second contact from said nozzle throat when said contacts are opened permitting an arc to arise between said contacts through said nozzle throat, and means for directing a dielectric gas into said nozzle for discharge through said nozzle throat, the size of said nozzle throat being selected so that the cross sectional area of said arc will substantially fill and clog said nozzle throat and restrict escape of said dielectric gas therefrom to an extent sufficient to raise the temperature within said nozzle such that significant ablation of said nozzle material occurs within said nozzle whereby a significant increase in pressure is produced within said nozzle to rapidly extinguish said arc.

10. A current interrupter as in claim 9 including actuating means for separating said contacts, and in which said means for directing dielectric gas into said nozzle includes a gas compressing chamber containing said dielectric gas mechanically connected to said actuating means such that said actuating means will simultaneously separate said contacts and pressurize and direct said dielectric gas into said nozzle.

11. A current interrupter as in claim 9 in which said current interrupter is adapted for interrupting alternating currents of the type which produce an arc when said contacts are opened which is periodic and has a periodic variation in said cross sectional area of said arc, the size of said nozzle throat being selected so that the varying cross sectional area of said periodic arc will substantially fill and clog said nozzle throat at least fifty percent of the time between contact separation and arc extinction.

12. A current interrupter as in claim 9 including an enclosure filled with said dielectric gas enclosing said contacts and said nozzle.

13. A current interrupter as in claim 12 in which said means for directing a dielectric gas into said nozzle includes a gas compressing chamber for pressurizing a portion of said dielectric gas in said enclosure and for directing the resultant pressurized dielectric gas produced by said gas compressing chamber into said nozzle.

14. A current interrupter as in claim 13 including actuating means for separating said contacts, said gas compressing chamber being mechanically connected to said actuating means such that said actuating means will simultaneously separate said contacts and pressurize and direct said dielectric gas into said nozzle.

15. A current interrupter as in claim 9 in which said nozzle is formed of Teflon.

16. A current interrupter as in claim 9 in which said dielectric gas is sulfur hexafluoride.

17. A current interrupter as in claim 9 in which the cross sectional area of said arc is dependent on the current carried by said arc, said interrupter contacts being selected to carry at least a predetermined magnitude of current which will produce said arc which substantially fills and clogs said nozzle throat.

* * * * *